US006266932B1

(12) United States Patent
Van Tassel

(10) Patent No.: US 6,266,932 B1
(45) Date of Patent: Jul. 31, 2001

(54) BOW MODULE PORTABLE MODULAR STRUCTURE

(76) Inventor: Harry Norman Van Tassel, 2055 McBride Street, Trail (CA), V1R 4L7

( * ) Notice: Subject to any disclaimer, the term of this patent is extended or adjusted under 35 U.S.C. 154(b) by 0 days.

(21) Appl. No.: 09/558,868

(22) Filed: Apr. 28, 2000

Related U.S. Application Data

(60) Provisional application No. 60/131,489, filed on Apr. 29, 1999.

(51) Int. Cl.[7] ..... E04H 1/32

(52) U.S. Cl. ..... 52/80.1; 52/86; 52/641; 52/644; 135/124; 135/906

(58) Field of Search ..... 52/80.1, 80.2, 52/81.2, 86, 639, 643, 644, 641; 135/122, 124, 125, 906

(56) References Cited

U.S. PATENT DOCUMENTS

| | | | | |
|---|---|---|---|---|
| 2,237,226 | * | 4/1941 | High | 52/643 X |
| 2,693,195 | * | 11/1954 | Frieder | 135/906 X |
| 2,797,696 | * | 7/1957 | Fritsche | 135/906 X |
| 3,042,053 | * | 7/1962 | Gabriel | 135/906 X |
| 3,690,078 | | 9/1972 | Maynard, Jr. | 52/86 |
| 3,798,851 | | 3/1974 | Utahara | 52/86 |
| 3,820,553 | | 6/1974 | Huddle | 135/130 |
| 3,892,094 | | 7/1975 | Spray | 135/125 |
| 3,925,942 | | 12/1975 | Hemmelsbach | 52/86 |
| 3,986,519 | * | 10/1976 | Gillis | 135/125 |
| 4,099,533 | * | 7/1978 | Gillis | 135/125 |
| 4,223,506 | * | 9/1980 | Blair et al. | 52/644 |
| 4,325,207 | * | 4/1982 | Russell et al. | 52/641 |
| 4,373,305 | * | 2/1983 | Russell | 52/86 |
| 4,404,980 | | 9/1983 | Wade | 135/102 |
| 4,953,329 | * | 9/1990 | Frantl | 52/86 X |
| 5,335,684 | | 8/1994 | Hanninen | 135/102 |
| 5,950,649 | * | 9/1999 | Gerig | 135/125 |

FOREIGN PATENT DOCUMENTS

| | | | | |
|---|---|---|---|---|
| 1150323 | * | 7/1986 | (SU) | 52/86 |
| 1244256 | * | 7/1986 | (SU) | 52/86 |

* cited by examiner

*Primary Examiner*—Robert Canfield
(74) *Attorney, Agent, or Firm*—Antony C. Edwards

(57) ABSTRACT

The bow module portable modular structure of the present invention includes: (a) a rigid, spaced apart, parallel array of arches, each lying in a vertical plane and spaced apart along a longitudinal axis, wherein each arch is formed of a unitary generally semi-circular bow member having rigid bracing members mountable thereto within a perimeter of the bow member, and (b) a rigid, spaced apart, substantially parallel array of cross-bracing bows mountable to the array of arches so as to be generally perpendicular to each arch, the array of cross-bracing bows radially spaced apart about a center of curvature of each arch in the array of arches.

16 Claims, 9 Drawing Sheets

BOW MODULE PORTABLE MODULAR STRUCTURE

CROSS REFERENCE TO RELATED APPLICATION

This application claims priority from United States Provisional Patent Application No. 60/131,489 filed Apr. 29, 1999 titled Outdoor Portable Modular Structure.

FIELD OF THE INVENTION

This invention relates to the field of modular structures which may be portable for use outdoors and which may be readily assembled and disassembled, and in particular, a modular structure having primarily arched or bow-shaped members used to create a structure such as shed or shelter.

BACKGROUND OF THE INVENTION

Modular skeleton-frame building structures are known in the prior art. As an example, such structures have a tubular steel frame covered with a sheathing of flexible materials such as plastic, canvas or the like. Many such prior art structures require a substantially large number of structural members to form an arcuate shaped frame and many of such structures cannot be disassembled quickly and easily by a relatively unskilled user.

In particular, in the prior art, applicant is aware of the following U. S. Pat. No. 3,690,078, No. 3,892,094, No. 3,798,851, No. 3,886,961, No. 4,404,980, and No. 5,335, 684.

SUMMARY OF THE INVENTION

The structure of the present invention is primarily formed of arches (primary bows) and cross-bracing (secondary) bows. An arch or primary bow is formed by a bow member having rigid bracing around its perimeter. The bow member may be an elongate member such as a length of tubing which may be aluminum tubing. The bow member is bent or otherwise formed into preferably a semi-circular or generally semi-circular shape. The bracing may be formed by bending two linear elongate members (herein referred to as first and second bracing members), which may also be tubing, at discrete bend positions, preferably but not necessarily regularly spaced apart, along the length of the members. The first bracing member is bent at the bend positions sufficiently so that it fits within the interior perimeter of the bow member. The second bracing member is slightly less bent at its bend positions than the first bracing member so that it fits within the exterior perimeter of the bow member snugly adjacent that is, alongside, the first bracing member when the first bracing member is mounted under the bow member. The first bracing member is mounted under the bow member at the intersections of its bend positions with the interior perimeter surface of the bow member. The second bracing member is mounted to one side surface of the bow member at the intersections of its bend positions with the side surface. The intersections of the bend positions of the first bracing member with the bow member, and the intersections of the bend positions of the second bracing member with the bow member are spaced apart along the length of the bow member so that the bracing provided by the first bracing member is radially offset about the center of curvature of the bow member relative to the bracing provided by the second bracing member.

In a preferred embodiment, the structure of the present invention comprises a spaced apart parallel array of arches or primary bows wherein each arch lies in a generally vertical plane. The plurality of such parallel arches may each be identically constructed. For ease of reference, the arches and the vertical planes containing those arches are referred to herein as extending laterally across a structure constructed of a spaced apart array of such arches. The spaced apart array of arches extends longitudinally along a center longitudinal axis of such a structure.

In one embodiment, the spaced apart array of arches may be spaced apart 2 feet between each arch and the structure comprises 5 such arches so that the longitudinal distance between the opposite-most arches is 8 feet.In this embodiment, a plurality of cross-bracing bows, in one embodiment constructed similarly to the primary bows, are used as longitudinally extending cross-bracing members or stringers mounted generally perpendicularly to the arches so as to support the arches in their spaced apart array. The cross-bracing bows may be coupled to the arches at the intersections of the bows with the arches.

In another preferred embodiment, foot ends of each arch may be mounted to at least one cross-bracing bow so as to form a base on at least one edge of the structure.

Additional crisscrossed pairs of long cross braces may be provided to support the longitudinally spaced array of arches in their parallel generally vertical orientation. In one embodiment, the long cross braces may extend between opposite ends of adjacent cross-bracing bows.

In summary then, the bow module portable modular structure of the present invention includes:

(a) a rigid, spaced apart, parallel array of arches, each lying in a vertical plane and spaced apart along a longitudinal axis, wherein each arch is formed of a unitary generally semi-circular bow member having rigid bracing members mounted or mountable thereto within a perimeter of the bow member, and (b) a rigid, spaced apart, substantially parallel array of cross-bracing bows mounted or mountable to the array of arches so as to be generally perpendicular to each arch, the array of cross-bracing bows radially spaced apart about a center of curvature of each arch in the array of arches.

The rigid bracing members may advantageously be elongate, linear first and second bracing members each bent at bend positions spaced apart along their respective lengths. The first and second bracing members are mounted or mountable to the bow member at the bend positions. In particular, the bend positions of the first bracing member are mounted or mountable to the bow member along an interior perimeter surface of the bow member. The bend positions of the second bracing member are mounted or mountable to the bow member along a side surface of the bow member so as to be adjacent the first bracing member when mounted to the bow member. The bend positions of the first bracing member are mounted or mountable to the bow member radially spaced apart, relative to the center of curvature of the bow member, from the bend positions of the second bracing member when mounted to the bow member.

Further advantageously, each cross-bracing bow in the array of cross-bracing bows includes an elongate arcuate member having rigid bracing mounted or mountable thereto. In particular, the rigid bracing may be elongate, linear third and fourth bracing members each bent at bend positions spaced apart along their respective lengths. The third and fourth bracing members are mounted or mountable to the bow member at their bend positions. In one aspect of the present invention the bend positions of the third bracing member are mounted or mountable to the bow member along an interior perimeter surface of the bow member, and the bend positions of the fourth bracing member are mounted or mountable to the bow member along a side surface of the bow member so as to be adjacent the third bracing member when mounted to the bow member. The bend positions of the third bracing member are mounted or mountable to the bow member radially spaced apart, relative to the center of curvature of the bow member, from the bend positions of the fourth bracing member when mounted to the bow member.

In a further aspect, each arch has a foot end and an opposite elevated end. The elevated ends of opposite end arches on opposite ends of the array of arches are supported in an elevated position by elevating supports mounted or mountable to the elevated ends of the opposite end arches.

DETAILED DESCRIPTION OF PREFERRED EMBODIMENTS

Figure 1:
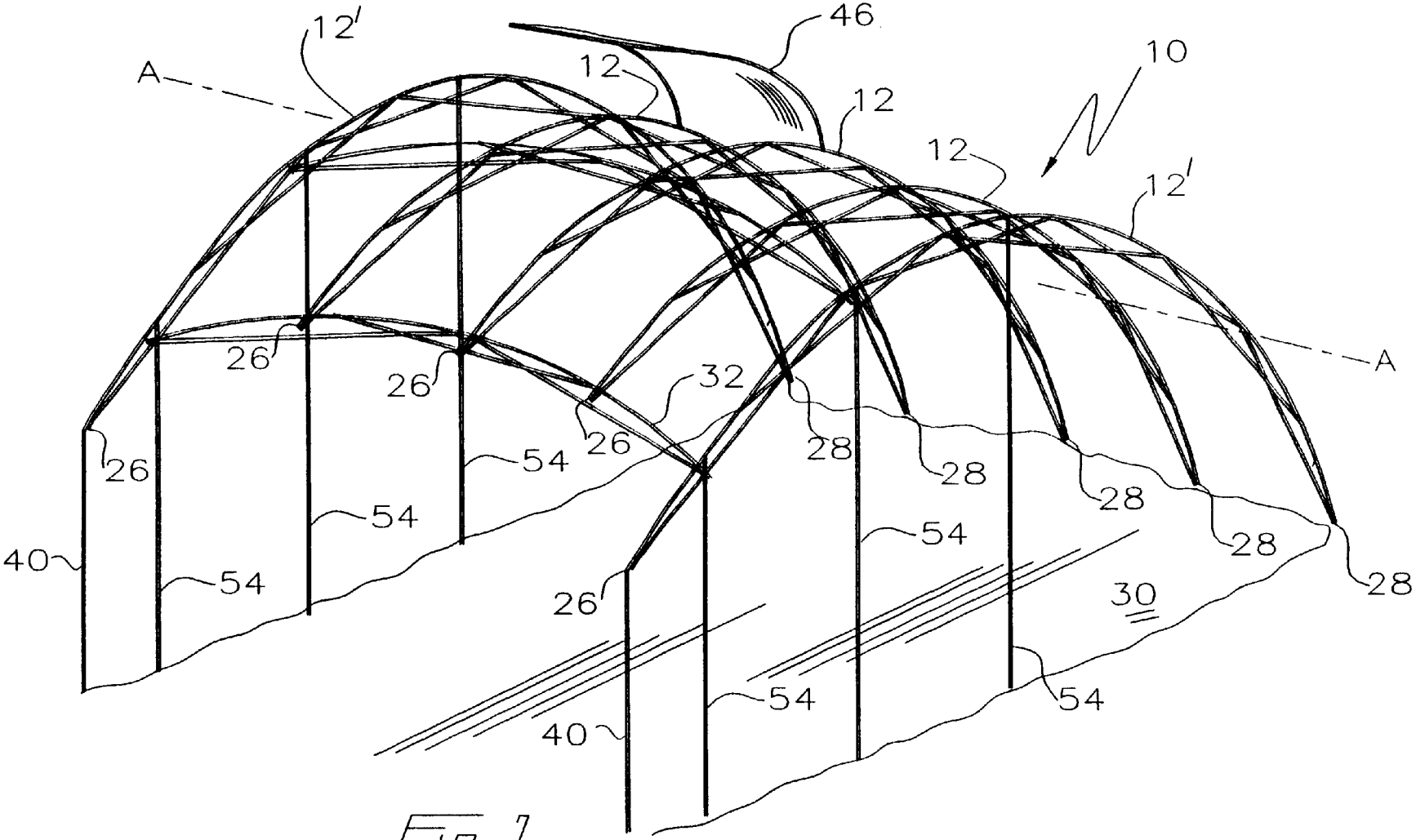
FIG. 1 is, in front perspective view, the modular bowed structure of the present invention.

As seen in FIG. 1, the modular bowed structure 10 of the present invention has arches 12 lying generally in parallel generally vertical spaced apart planes longitudinally spaced apart along a longitudinal axis A. Arches 12 extend laterally of longitudinal axis A generally orthogonally thereto. In the embodiment illustrated, but not intended so as to be limiting, the longitudinal spacing between arches 12 is 2 feet so that, the longitudinal distance spanned by a longitudinal spaced array of five arches 12 is 8 feet. Each arch 12 is constructed in three stages as seen progressively constructed in FIGS. 2–4.

Figure 2:
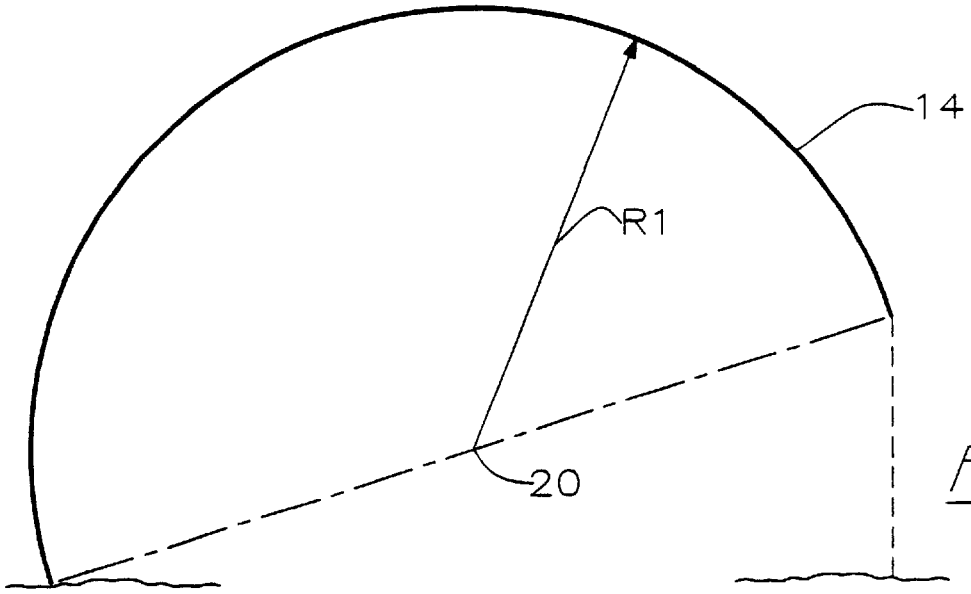
FIG. 2 is, in side elevation view, the bow member in the three stage construction of an arch of the modular bowed structure of the present invention.
Figure 3A:
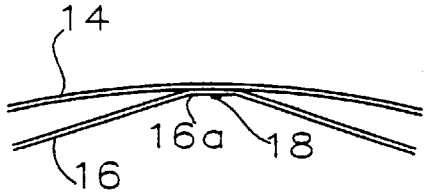
FIG. 3*a* is an enlarged view of a portion of FIG. 3.
Figure 3:
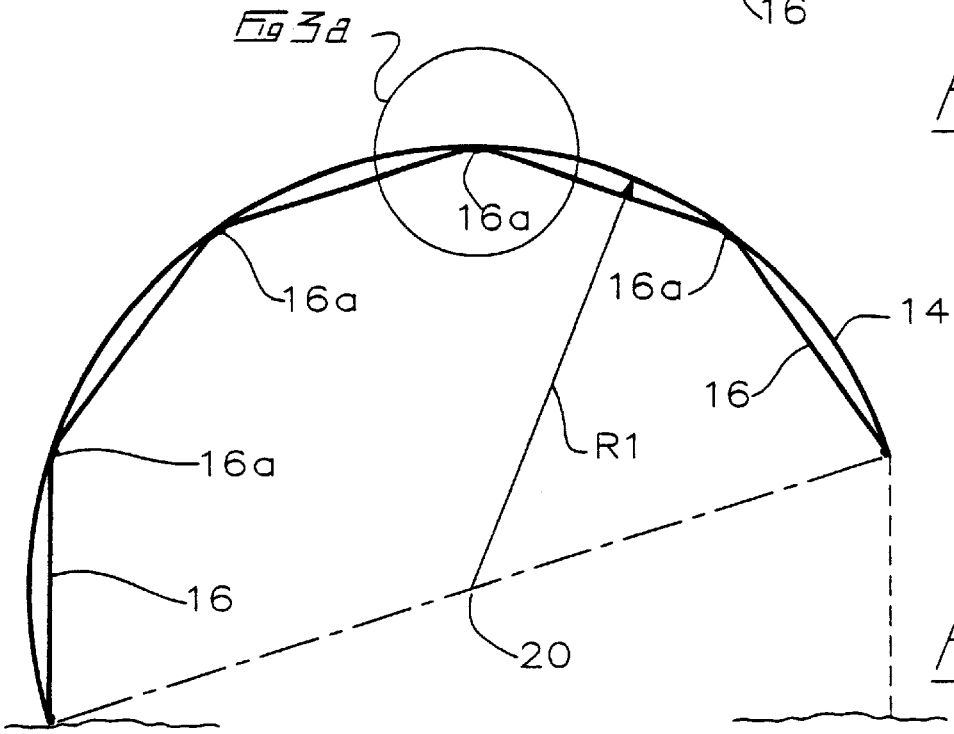
FIG. 3 is, in side elevation view, the bow member and first bracing member in the second stage in the construction of the arch of FIG. 2.

As seen in FIG. 2, in one preferred embodiment, each arch 12 has a bow member 14 which forms the backbone of the arch. As seen in FIG. 3, a first bracing member 16, formed by bending a linear rigid member at regular intervals along its length so as to fit into the arch of bow member 14, is mounted at its bend positions 16*a* to bow member 14, for example by means of bolts or screws 18 better seen in FIG. 3*a*. First bracing member 16 thus provides linear bracing of bow member 14 between bend positions 16*a*. Members 14 and 16 may be constructed of tubing as for example aluminum tubing.

Figure 4:
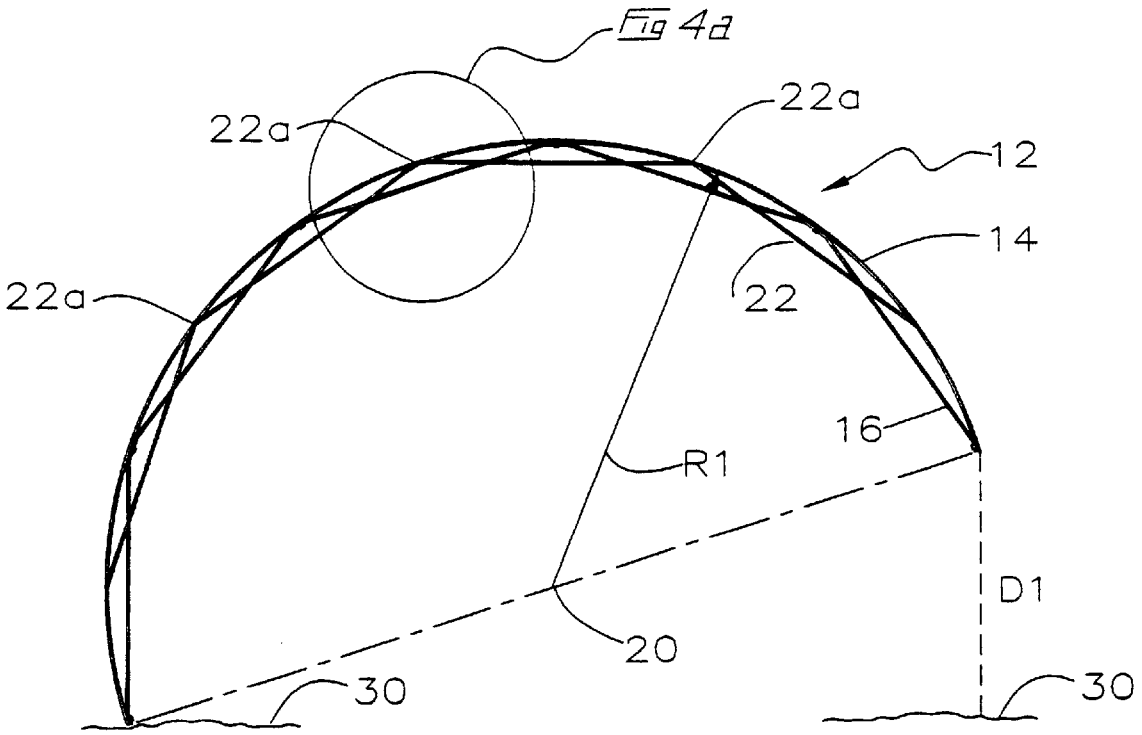
FIG. 4 is, in side elevation view, the bow member and first and second bracing members in the third stage of the construction of the arch of FIG. 2.
Figure 4A:
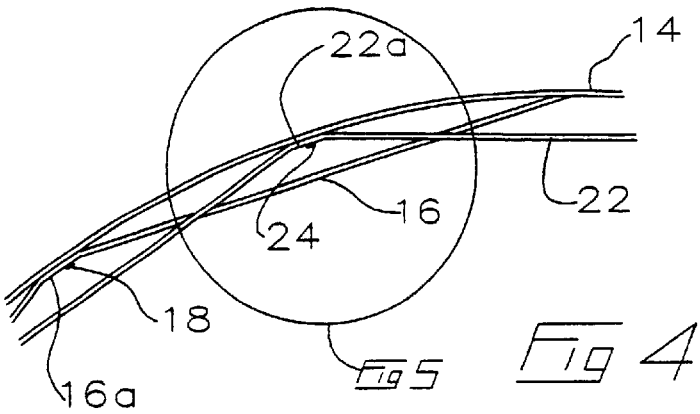
FIG. 4*a* is an enlarged view of a portion of FIG. 4.
Figure 5:
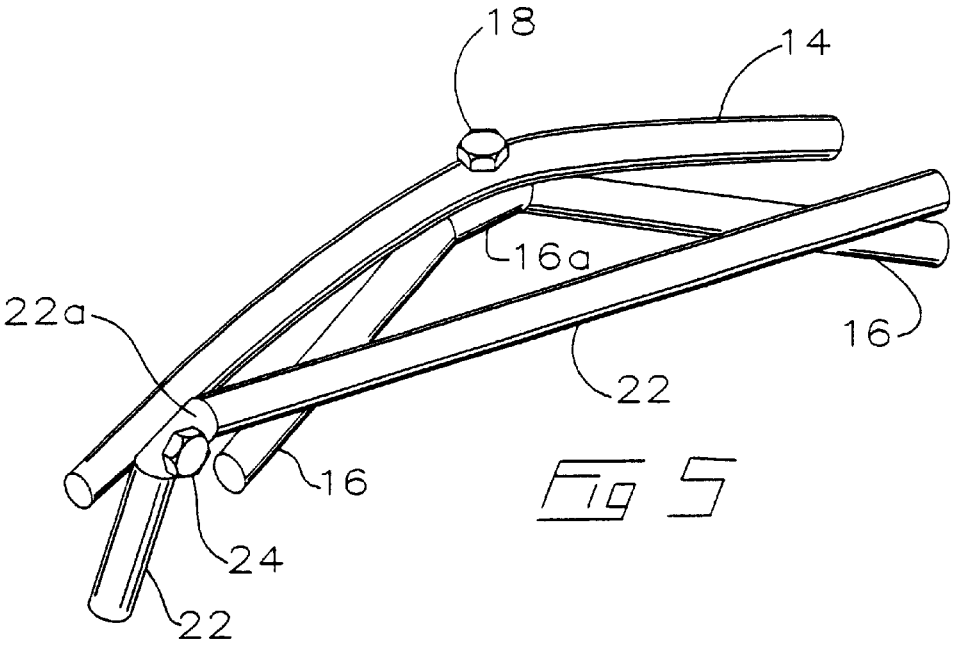
FIG. 5 is an enlarged perspective view of a portion of FIG. 4*a*.

As seen in FIG. 4, further bracing of bow member 14 is provided by a second bracing member 22. Similar to first bracing member 16, second bracing member 22 is an elongate, preferably linear, rigid member bent at regular intervals indicated as bend positions 22*a*. As better seen in FIG. 4*a*, member 22 is mounted to bow member 14, alongside member 14 so as to be adjacent member 16. Member 22 is mounted to the side of bow member 14 at bend positions 22*a* by means of bolts or screws 24. Bend positions 22*a* are mounted to bow member 14 intermediate bend positions 16*a* so that the bracing of bow member 14 provided by members 16 and 22 is equally radially spaced apart about center of curvature 20. Second bracing members 22 may also be tubing such as aluminum tubing. Bend positions 16*a* and 22*a* may be formed by manual crimping and bending of the tubing or by folding of the tubing in a jig. A better detailed view of the mounting of members 16 and 22 to bow member 14 at bend positions 16*a* and 22*a* is seen in FIG. 5.

In one preferred embodiment, although not intending to be limiting, the distance between bend positions 16*a* may be 5 feet and the radius of curvature $R_1$ of first bowed members 14 may be 8 feet. Radius of curvature $R_1$ has a center of curvature 20.

Arches 12 have at opposite ends elevated ends 26 and foot ends 28. Elevated ends 26 are maintained elevated above the ground a distance $D_1$ by cross-bracing as better described below. Arches 12 are generally coplanar and in the resulting structure 10 arches 12 lie in generally vertical parallel planes and foot ends 28 rest on the surface of ground or other base or foundation material 30. Center of curvature 20 for each arch 12 lies on a chord shown in dotted outline extending between elevated end 26 and foot end 28.

Figure 6:
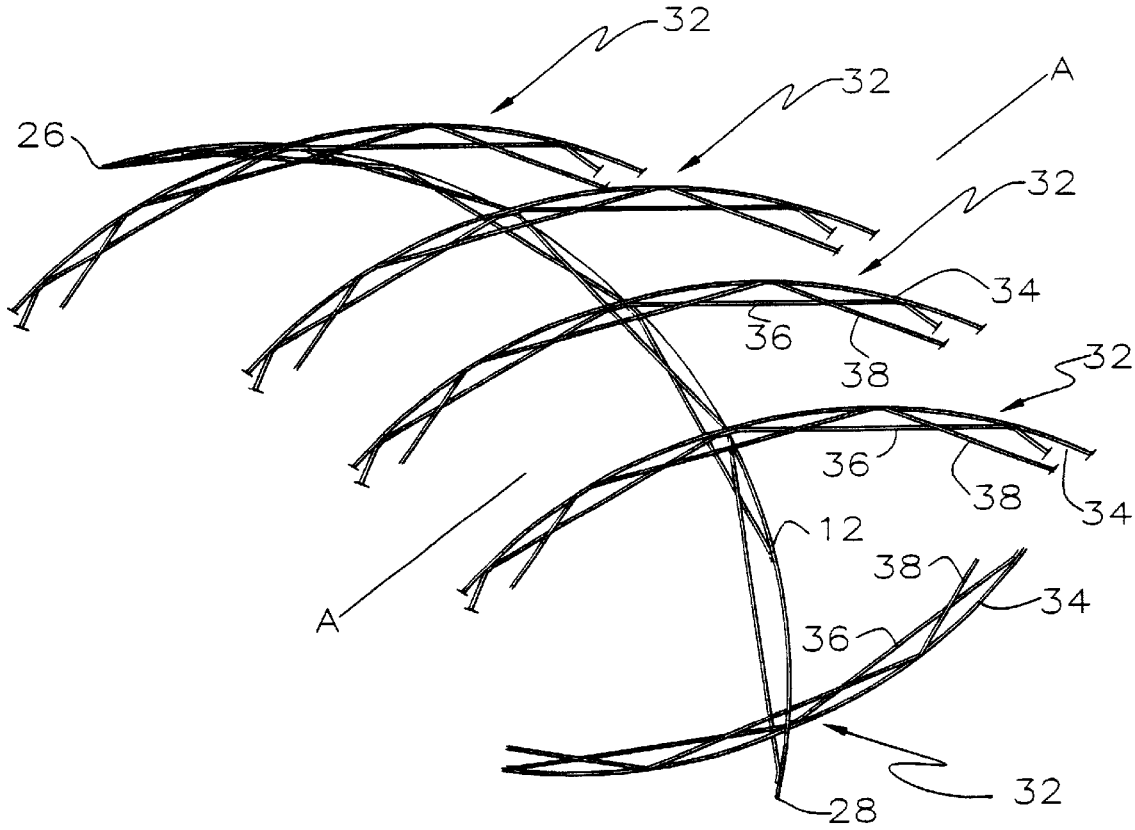
FIG. 6 is a rear perspective view of the structure of FIG. 1 showing a spaced apart array of cross bow members mounted transversely along a single arch of FIG. 4.

Arches 12 are held rigidly in their parallel spaced apart array by longitudinal cross-bracing bows 32. In FIG. 1 only two bows 32 are illustrated for sake of clarity, it being understood that a plurality of bows 32 are rigidly mounted spaced apart along the length of arches 12, for example as better seen in FIG. 6 which illustrates a spaced apart array of bows 32 spaced apart along a single arch 12.

Longitudinal cross-bracing bows 32 may advantageously be constructed in a manner similar to arches 12. Thus each bow 32 has an arched or bowed bow member 34 which forms the backbone of the cross-brace braced by third and fourth bracing members 36 and 38 respectively. Member 36 is mounted to bow member 34 at regular intervals around the interior circumference of bow member 34. Member 38 is mounted adjacent to member 36 at regular intervals around the side surface of bow member 34. Both members 36 and 38 may be formed by bending an elongate linear member such as an elongate piece of aluminum tubing. The bend positions along both members 36 and 38 are used for mounting to the interior surface and side surface respectively of bow member 34. Members 36 and 38 may be rigidly mounted to bow members 34 using bolts, screws or other fastening means. Again, member 38 bend positions are mounted to bow member 34 intermediate the member 36 bend positions whereat member 36 is mounted to bow member 34. In this manner, the cross braces provided by members 36 and 38 are offset relative to each other along the length of bow member 34.

Elevated ends 26 of the arches 12' which form the arches at opposite ends of the spaced apart array of arches 12, are supported elevated $D_1$ above ground 30 by vertical support members 40. Vertical support members 40 may also be elongate rigid tubing such as aluminum tubing.

Arches 12 and bows 32 may be entirely constructed of aluminum tubing, for example of ½ inch inside diameter and ⅞'s inch outside diameter.

Figure 7:
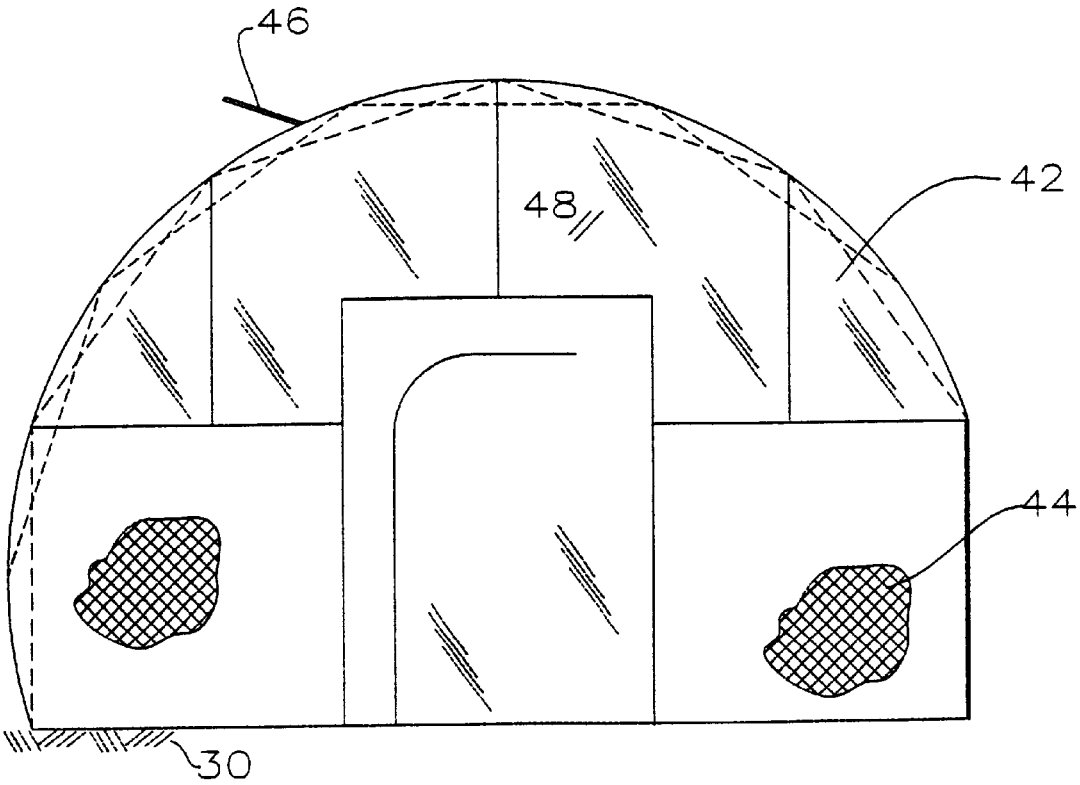
FIG. 7 is a left side elevation view of the structure of FIG. 1 covered by sheathing panels.
Figure 8:
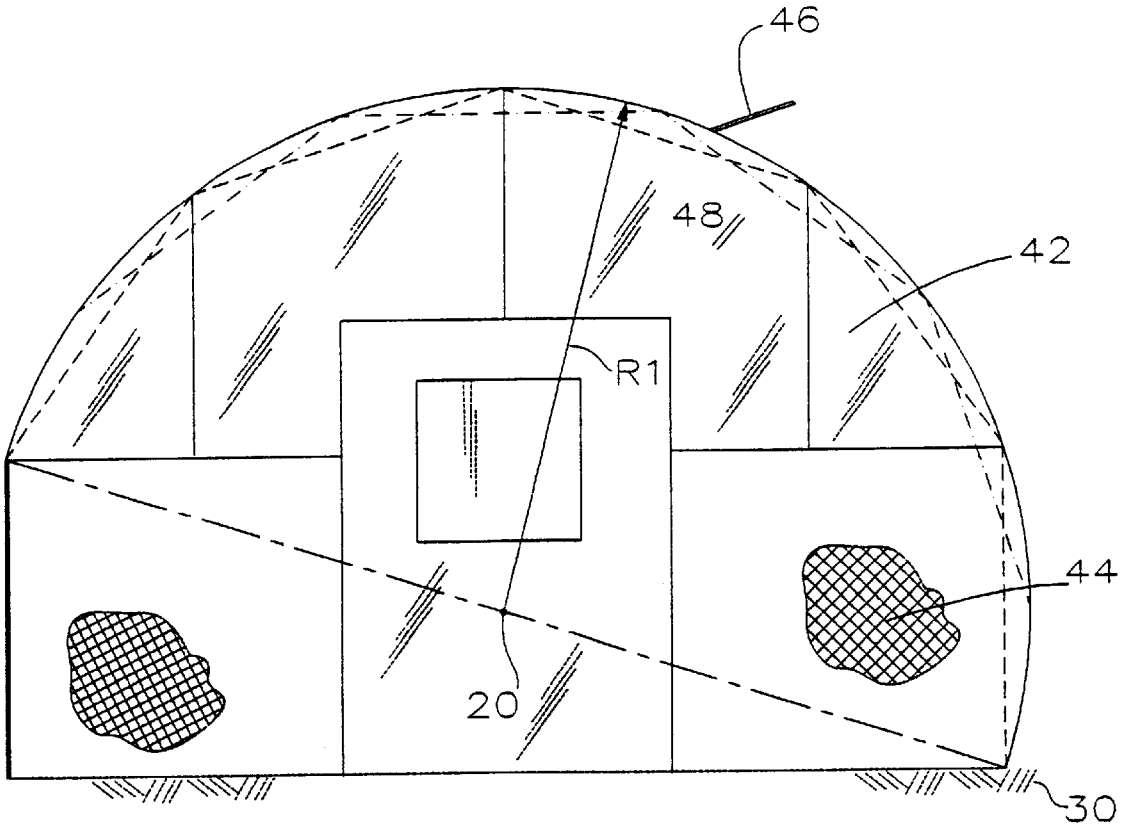
FIG. 8 is a right side elevation view of the structure of FIG. 1 covered by sheathing panels.

A vent or plurality of vents 46 may be pivotally mounted preferably in the upper region of structure 10. Vents 46 are pivotally mounted to the frame members, for example adjacent arches 12, so as to provide interior ventilation by being pivotable from a closed position to an elevated open position, the latter as seen better in FIG. 1. In the embodiments shown in FIGS. 7 and 8 structure 10 is covered by sheathing 48 which may be comprised of upper tarp sections 42 and lower net sections 44 or any combination, as someone skilled in the art would know to adapt for various climates and the various applications of the present structure.

Figure 9:
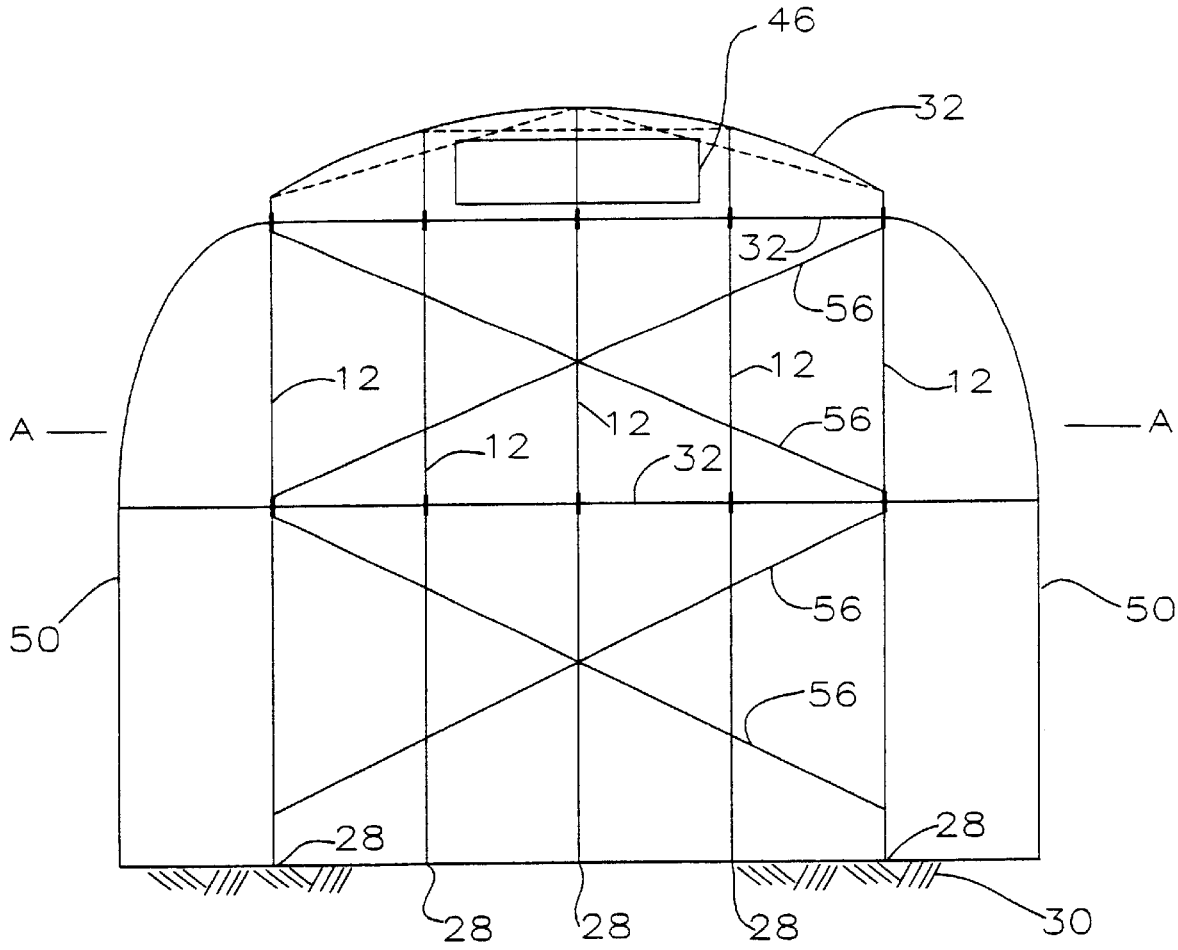
FIG. 9 is a rear elevation view of an alternative embodiment of the present invention in which the structure of FIG. 1 is enlarged by opposed facing lean-to sides.
Figure 10:
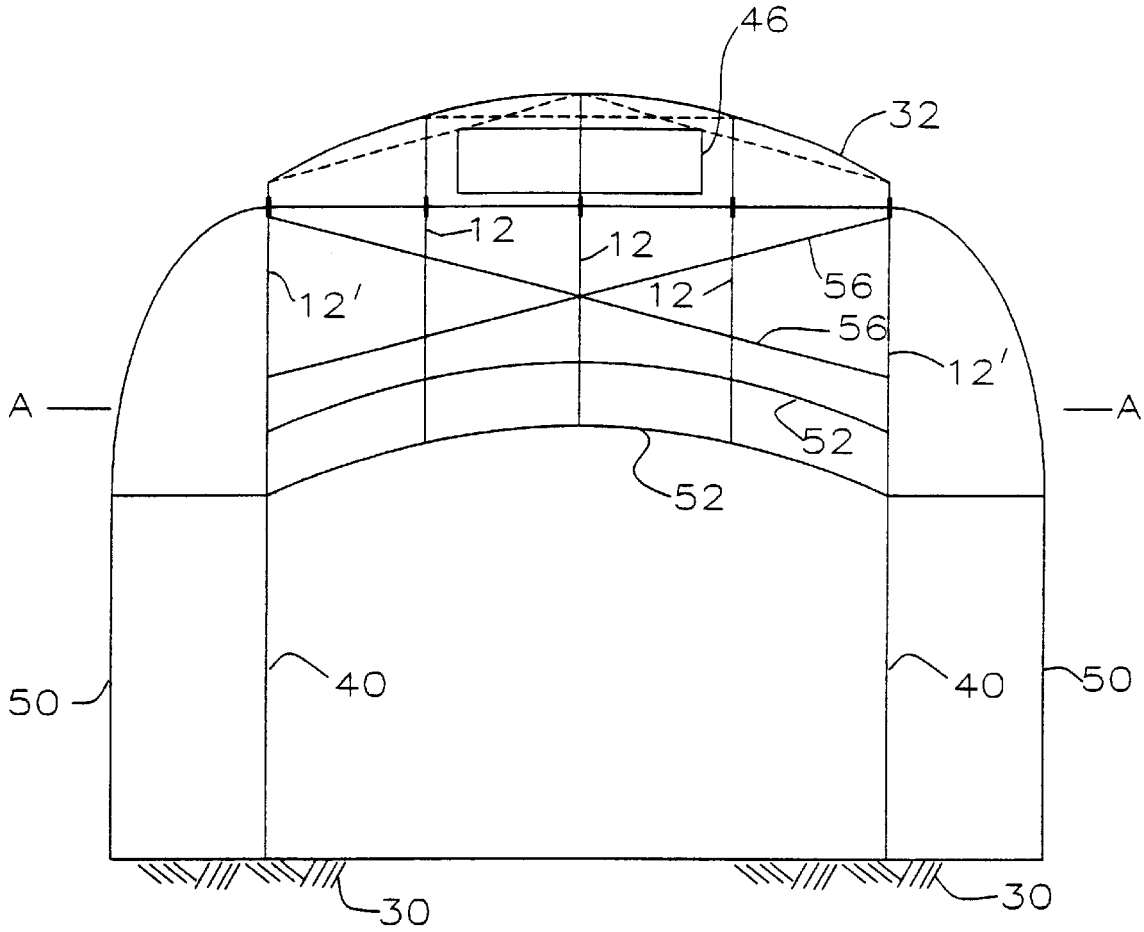
FIG. 10 is a front elevation view of the embodiment of FIG. 9.

In FIGS. 9 and 10, sheathing 48 is removed so as to expose the underlying structure 10. However, it is understood that the entire structure may be covered or portions thereof and that the ends of the structure may incorporate windows, doors, releasably fastened by various means known in the art, and that the interior of structure 10 may be adapted so that netting or the like may be hung inside the structure, for example suspended from hanging rods 52, when used as a golfing range shed. Thus a person may stand in the shed and hit golf balls into a net (not shown) hanging down from rods 40.

In a preferred embodiment, but without intending to be limiting, to expand the interior volume of structure 10 and to increase the aesthetic appeal of the overall structure when covered in sheathing 48, advantageously lean-to sides 50, which may also be formed of curved and linear pieces of tubing, are fastened to the longitudinal ends of the array of arches 12, that is, they may be fastened to the ends of bows 32. In this fashion, structure 10 may be given a pleasing and volumetrically expanded rounded or dome-like exterior appearance when covered in sheathing 48. Alternatively, vertical support poles 54 may be substituted for lean-to sides 50.

Any further alternative embodiment, further cross bracing of arches 12 may be provided, in addition to bows 32, by tensioned wire cables 56 or the like.

Figure 11:
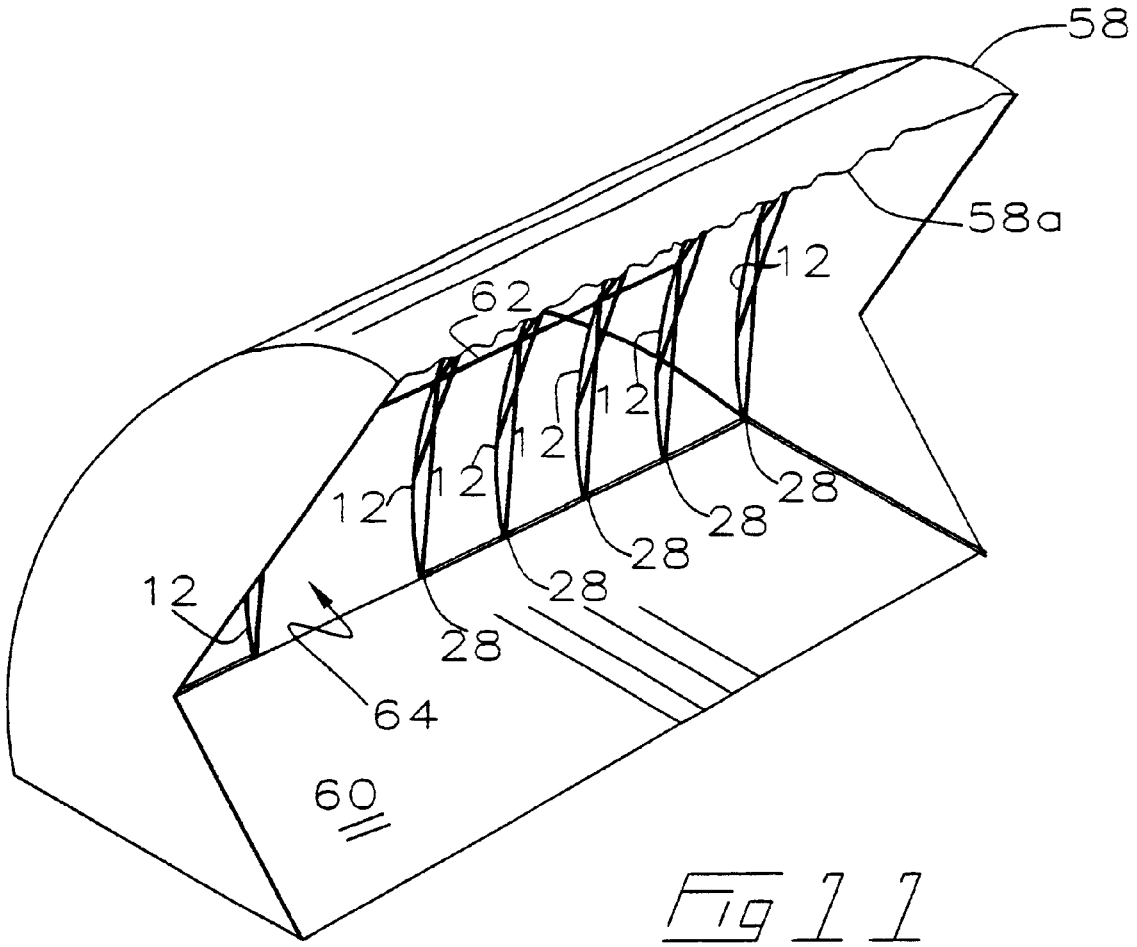
FIG. 11 is, in perspective view, a further alternative embodiment of the present invention providing an open-sided enclosure.

As seen in FIG. 11, a further alternative embodiment of the present invention uses arches 12 to support a canopy 58. The foot ends 28 of arches 12 again support the lowermost ends of the arches 12. The opposite elevated ends 26 which cannot be seen in FIG. 11 because of canopy 58, support the upper edge 58*a* of the canopy suspended over a covered area 60. Arches 12 are held in parallel spaced apart array by, for example, cross members 62. An entryway 64 may be provided between adjacent arches 12 and a corresponding aperture in canopy 58 for access by a user to covered area 60. Thus this alternative embodiment might be employed for covering golfers using a golfing range.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A bow module portable modular structure comprising:

(a) a rigid, spaced apart, parallel array of arches spaced apart along a longitudinal axis, wherein each arch in said array of arches is formed of a unitary generally semi-circular bow member having rigid bracing members mountable thereto within a perimeter of said bow member, and wherein said each arch lies in a substantially vertical plane perpendicular to said longitudinal axis, and (b) a rigid, spaced apart, substantially parallel array of cross-bracing bows mountable to said array of arches so as to be generally perpendicular to said each arch in said array of arches, said array of cross-bracing bows radially spaced apart about a center of curvature of said each arch in said array of arches.

2. The structure of claim 1 wherein each cross-bracing bow in said array of cross-bracing bows comprises an elongate arcuate member having rigid bracing mountable thereto within a perimeter of said arcuate member.

3. The structure of claim 1 wherein said rigid bracing members are elongate linear first and second bracing members each bent at bend positions spaced apart along their respective lengths, said first and second bracing members mountable to said bow member at said bend positions.

4. The structure of claim 3 wherein said bend positions of said first bracing member are mountable to said bow member along an interior perimeter surface of said bow member and wherein said bend positions of said second bracing member are mountable to said bow member along a side surface of said bow member adjacent said first bracing member when mounted to said bow member, said bend positions of said first bracing member mountable to said bow member radially spaced apart, relative to said center of curvature, from said bend positions of said second bracing member when mounted to said bow member.

5. The structure of claim 4 wherein each cross-bracing bow in said array of cross-bracing bows comprises an elongate arcuate member having rigid bracing mountable thereto.

6. The structure of claim 5 wherein said rigid bracing are elongate linear third and fourth bracing members each bent at bend positions spaced apart along their respective lengths, said third and fourth bracing members mountable to said arcuate member at said bend positions.

7. The structure of claim 6 wherein said bend positions of said third bracing member are mountable to said arcuate member along an interior perimeter surface of said arcuate member and wherein said bend positions of said fourth bracing member are mountable to said arcuate member along a side surface of said arcuate member adjacent said third bracing member when mounted to said arcuate member, said bend positions of said third bracing member mountable to said arcuate member radially spaced apart, relative to said center of curvature, from said bend positions of said fourth bracing member when mounted to said arcuate member.

8. The structure of claim 1 wherein said each arch has a foot end and an opposite elevated end, wherein said elevated ends of opposite end arches on opposite ends of said array of arches are supported in an elevated position by elevating supports mountable to said elevated ends of said opposite end arches.

9. A bow module portable modular structure comprising:

(a) a rigid, spaced apart, parallel array of arches spaced apart along a longitudinal axis, wherein each arch in said array of arches is formed of a unitary generally semi-circular bow member having rigid bracing members mounted thereto within a perimeter of said bow member, and wherein said each arch lies in a substantially vertical plane perpendicular to said longitudinal axis, and (b) a rigid, spaced apart, substantially parallel array of cross-bracing bows mounted to said array of arches so as to be generally perpendicular to said each arch in said array of arches, said array of cross-bracing bows radially spaced apart about a center of curvature of said each arch in said array of arches.

10. The structure of claim 9 wherein each cross-bracing bow in said array of cross-bracing bows comprises an elongate arcuate member having rigid bracing mounted thereto within a perimeter of said arcuate member.

11. The structure of claim 9 wherein said rigid bracing members are elongate linear first and second bracing members each bent at bend positions spaced apart along their respective lengths, said first and second bracing members mounted to said bow member at said bend positions.

12. The structure of claim 11 wherein said bend positions of said first bracing member are mounted to said bow member along an interior perimeter surface of said bow member and wherein said bend positions of said second bracing member are mounted to said bow member along a side surface of said bow member adjacent said first bracing member when mounted to said bow member, said bend positions of said first bracing member mounted to said bow member radially spaced apart, relative to said center of curvature, from said bend positions of said second bracing member when mounted to said bow member.

13. The structure of claim 12 wherein each cross-bracing bow in said array of cross-bracing bows comprises an elongate arcuate member having rigid bracing mounted thereto.

14. The structure of claim 13 wherein said rigid bracing are elongate linear third and fourth bracing members each bent at bend positions spaced apart along their respective lengths, said third and fourth bracing members mounted to said arcuate member at said bend positions.

15. The structure of claim 14 wherein said bend positions of said third bracing member are mounted to said arcuate member along an interior perimeter surface of said arcuate member and wherein said bend positions of said fourth bracing member are mounted to said arcuate member along a side surface of said arcuate member adjacent said third bracing member when mounted to said arcuate member, said bend positions of said third bracing member mounted to said arcuate member radially spaced apart, relative to said center of curvature, from said bend positions of said fourth bracing member when mounted to said arcuate member.

16. The structure of claim 9 wherein said each arch has a foot end and an opposite elevated end, wherein said elevated ends of opposite end arches on opposite ends of said array of arches are supported in an elevated position by elevating supports mounted to said elevated ends of said opposite end arches.

* * * * *